US007566488B2

(12) United States Patent
Mimura et al.

(10) Patent No.: US 7,566,488 B2
(45) Date of Patent: Jul. 28, 2009

(54) SURFACE MATERIAL FOR BALL AND BALL

(75) Inventors: Masahisa Mimura, Ooda (JP); Shogo Takahashi, Ooda (JP)

(73) Assignee: Teijin Cordley Limited, Shimane (JP)

( * ) Notice: Subject to any disclaimer, the term of this patent is extended or adjusted under 35 U.S.C. 154(b) by 466 days.

(21) Appl. No.: 10/549,042

(22) PCT Filed: Mar. 17, 2004

(86) PCT No.: PCT/JP2004/003537

§ 371 (c)(1),
(2), (4) Date: Sep. 15, 2005

(87) PCT Pub. No.: WO2004/082774

PCT Pub. Date: Sep. 30, 2004

(65) Prior Publication Data

US 2006/0199686 A1 Sep. 7, 2006

(30) Foreign Application Priority Data

Mar. 18, 2003 (JP) ..... 2003-073666
Jun. 16, 2003 (JP) ..... 2003-170378

(51) Int. Cl.
*A63B 41/08* (2006.01)
*B32B 3/24* (2006.01)

(52) U.S. Cl. ..... 428/151; 428/904; 428/137; 428/138; 473/594; 473/596; 473/604; 473/607; 473/614

(58) Field of Classification Search ..... 428/151, 428/904, 137, 138; 473/594, 596, 604, 607, 473/614

See application file for complete search history.

(56) References Cited

U.S. PATENT DOCUMENTS

| | | | | |
|---|---|---|---|---|
| 4,053,676 | A * | 10/1977 | Kaminstein | 428/313.5 |
| 4,462,590 | A | 7/1984 | Mitchell | |
| 4,515,852 | A | 5/1985 | Katabe et al. | |
| 6,024,661 | A * | 2/2000 | Guenther et al. | 473/605 |

FOREIGN PATENT DOCUMENTS

| | | | |
|---|---|---|---|
| JP | 11155/1976 | | 1/1976 |
| JP | 62-225582 | A | 11/1985 |
| JP | 2000-102629 | A | 4/2000 |
| JP | 2000-328465 | A | 11/2000 |
| JP | 3-173776 | B2 | 6/2001 |
| JP | 2002-159597 | A | 6/2002 |
| JP | 2003-49370 | A | 2/2003 |

* cited by examiner

*Primary Examiner*—William P Watkins, III
(74) *Attorney, Agent, or Firm*—Sughrue Mion, PLLC

(57) ABSTRACT

A skin material for balls which is a sheet-form material comprising a base layer and formed on one side there of a coating layer made of a polymeric elastomer, characterized in that (1) the coating layer is composed of three layers (C-1), (C-2), and (C-3) disposed in this order from the surface side, (2) the layer (C-3) on the base layer side is made of a porous polymeric elastomer, (3) the layer (C-1) on the surface side is made of a polymeric elastomer containing a pressure-sensitive adhesive, and (4) the coating layer comprises one or more polymeric elastomers which have or do not have fine through-holes extending from the surface side to the base layer; and a ball having the skin material bonded to the surface. The skin material for ball-game balls brings about excellent wet gripping and is excellent also in wearing resistance and impact absorption.

29 Claims, No Drawings

SURFACE MATERIAL FOR BALL AND BALL

DETAILED DESCRIPTION OF THE INVENTION

1. Field of the Invention

The present invention relates to a surface material for balls. More specifically, it relates to a surface material for balls that is excellent in gripping characteristic at a moistened time and abrasion resistance, which is soft and excellent in impact absorption and which is suitable for balls for games such as a basketball, rugby, American football, handball, volleyball, baseball, and the like, 2. Prior Art Natural leather has been long since used as a surface material for balls for games, and in recent years, there is also used a so-called artificial leather made from a fiber and a elastic polymer due to an easiness in handling. For attaining abrasion resistance and preventing the adherence of soiling, however, a skin layer made of a elastic polymer is formed on the surface of the artificial leather of a whole surface of ball, so that the artificial leather is slippery. Particularly, when players are sweating in hands in ball games in which balls are manually handled, such as a basket ball, rugby, American football, handball, volleyball, baseball, and the like, a slipperiness is liable to take place on the balls.

As one of means for decreasing the above slipperiness and improving the balls in gripping characteristic at a moistened time, one method is thinkable in which a soft and flexible material having air permeability and moisture permeability is used as a surface material for the balls. Air-permeable, moisture-permeable artificial leather is, for example, a conventional embodiment of such a sheet. It is thinkable to employ a method in which a good solvent solution of a elastic polymer for forming a porous surface is applied to the surface of an artificial leather by a wet method to form open pores on the surface, as is disclosed in International PCT Publication WO94/20665. According to studies made by the present inventors, however, the open pores exist in a portion that comes in contact with hands and the ground, so that the above artificial leather has not been satisfactory with regard to soiling resistance and abrasion resistance of a surface material for the balls.

As another method, JP-A-9-250091 discloses a method in which the surface of an artificial leather having vertical fluffs is discontinuously provided with a resin that exhibits non-slipperiness. However, the above vertical-fluffs portion has fluffs from the beginning although it has water-absorptivity, the vertical-fluffs portion is insufficient in durability and abrasion resistance, and the artificial leather is liable to be easily soiled since no film layer is formed on the surface. There is also a problem that the artificial leather is also poor in gripping characteristic.

On the other hand, for example, JP-A-2000-328465 discloses, as a surface material for balls for games, a leather-like sheet for balls which comprises a fiber-intertwined material, a porous elastomer existing in spaces of the intertwined material, a porous base material layer and a porous surface layer formed on the surface thereof.

Since, however, the above artificial leather is formed of a fiber and a elastic polymer adhering thereto, it has a problem that its impact absorption strength is low, and there has been obtained no artificial leather for balls which satisfies both impact absorption capability and abrasion resistance in particular. There has been therefore demanded an artificial leather surface material for balls, which is most suitable for ball games in which balls are frequently handled by hands such as volleyball, basket ball, rugby, American football, baseball, and the like, and which exhibits an excellent decrease in impact strength when balls are handed from one player to another.

PROBLEMS TO BE SOLVED THE INVENTION

It is a first object of the present invention to provide a surface material that is excellent in gripping characteristic when it is dry and when it is moistened and which is excellent in abrasion resistance and suitable as skins of balls for ball games.

It is a second object of the present invention to provide a surface material that is soft, excellent in impact absorption capability and excellent in abrasion resistance and which is suitable as a skin of balls for ball games.

It is a third object of the present invention to provide balls that are balls for ball games, which are excellent in gripping characteristic when they are dry and when they are moistened, and which are excellent in abrasion resistance and also excellent in impact absorption capability.

MEANS TO SOLVE THE PROBLEMS

According to studies made by the present inventors, the above objects of the present invention can be achieved by the following surface materials (1) to (III) for balls and a ball (IV).

(I) A surface material for balls, formed of a sheet-shaped material having a coating layer formed from a elastic polymer on one surface of a base material layer, (1) said coating layer being formed of three layers C-1, C-2 and C-3 which are arranged in the order of C-1, C-2 and C-3 from a front surface side, (2) the layer C-3 being present on the base material layer side and formed from a porous elastic polymer, (3) the layer C-1 being present on the front surface side and being formed from a elastic polymer containing an tackifier, and (4) the coating layer being formed from the elastic polymers having fine through holes reaching the base material layer side from the front surface side or having no such fine through holes.

(II) A surface material for balls, formed of a sheet-shaped material having a coating layer formed from a elastic polymer on one surface of a base material layer, (1) said coating layer being formed of three layers C-1, C-2 and C-3 which are arranged in the order of C-1, C-2 and C-3 from a front surface side, (2) the layer C-3 being present on the base material layer side and formed from a porous elastic polymer, (3) the layer C-1 being present on the front surface side and being formed from an elastic polymer containing an tackifier, (4) the coating layer being formed from the elastic polymers having fine through holes reaching the base material layer from the front surface side or having no such fine through holes, (5) the coating layer having a number of hills and valleys having a valleys-and-hills height difference of 0.1 to 1.0 mm on the surface thereof, and (6) the hills and valleys having hill top portions having a total area that is 20 to 70% based on the area of the coating layer.

(III) A surface material for balls, formed of a sheet-shaped material having a coating layer formed from a elastic polymer on one surface of a base material layer, (1) said coating layer being formed of three layers C-1, C-2 and C-3 which are arranged in the order of C-1, C-2 and C-3 from a front surface side, (2) the layer C-3 being present on the base material layer side and formed from a porous elastic polymer, (3) the layer C-1 being present on the front surface side and being formed from a elastic polymer containing an tackifier, (4) the coating layer being formed from the elastic polymers having fine through holes reaching the base material layer from the front surface side or having no such fine through holes, and (5) the coating layer having a surface having substantially flat and smooth surfaces.

(IV) a ball comprising a ball body having a surface to which the surface material for balls, recited in any one of the above (I) to (III), is bonded.

The surface materials and the ball, provided by the present invention, will be more specifically explained below.

The sheet-shaped material for constituting the surface material for balls, provided by the present invention, is a material in which a coating layer is formed on one surface of a base material layer and integrated with the base material layer. The coating layer is formed from elastic polymer and has a three-layer structure formed of a layer C-1, a layer C-2 and a layer C-3 which are present in this order from the front surface side. When the sheet-shaped material in the present invention is explained in a simple manner, it has the structure of a layer C-1/layer C-2/layer C-3/base material layer arranged in this order from the front surface side. In the present invention, therefore, the "front surface side" means the surface of the layer C-1 (a surface opposite to the base material layer) that is the outermost surface of the sheet-shaped material.

The base material layer for forming the sheet-shaped material in the present invention is a composite layer formed from a fibrous base material and an elastic polymer.

The above fiber for use in the fibrous base material includes synthetic fibers such as polyamide and polyester, regenerated fibers such as rayon and acetate and natural fibers or mixtures of these fibers. The above fiber more preferably includes polyamide fibers such as nylon 6, nylon 66 and nylon 12 and polyester fibers such as polyethylene terephthalate and polybutylene terephthalate.

The above fibrous base material is preferably an intertwined fiber non-woven fabric prepared from the above fiber by known means such as carding, webber, layering, needle punching, or the like. Particularly, it is preferably an intertwined fiber non-woven fabric formed of a very fine fiber having a size of 2 dtex or less, particularly preferably, formed of a very fine fiber having a size of 0.0001 to 0.05 dtex. In a method of obtaining such a very fine fiber, for example, there is prepared a conjugate fiber or a blend-spun fiber formed from at least two components that are fiber-formable elastic polymer different from each other in solvent solubility, an intertwined fiber non-woven fabric is prepared and one component is removed by extraction, whereby a very fine fiber intertwined fibrous base material can be obtained.

Properly, the above fibrous base material has an apparent density of 0.05 to 0.20, preferably 0.1 to 0.15 g/cm$^3$. For improving an obtained surface material in impact absorption capability, particularly preferably, the fibrous base material has a low density, and the above apparent density is preferably 0.05 to 0.14 g/cm$^3$, more preferably 0.09 to 0.12 g/cm$^3$.

The elastic polymer for use in the base material layer together with the above fibrous base material includes polyurethane elastomer, polyurethane urea elastomer, polyurea elastomer, polyester elastomer and a synthetic rubber. Of these, polyurethane elastomer is preferred. For improving the surface material in impact absorption capability, preferably, the elastic polymer has a 100% elongation stress of 80 to 100 kg/cm$^2$. Further, the elastic polymer of the base material layer is preferably porous, and it is preferred to use a polyurethane that is soluble in DMF and can be coagulated by a wet method.

Further, the amount ratio of the elastic polymer in the base material layer to the fiber in the fibrous base material, as a elastic polymer/fiber ("R/F" hereinafter) weight ratio, is preferably in the range of 20/100 to 40/100.

The base material layer has a thickness of b 0.3 to 3 mm, preferably 0.4 to 2 mm, which is desirable for use as a surface material for balls.

The surface material of the present invention has a coating layer on one surface of the above base material layer. The coating layer is consecutively formed of three layers such as a layer C-1, a layer C-2 and a layer C-3, and the layer C-3 is in contact with the surface of the base material layer.

In the above coating layer, the layer C-3 is formed of a porous elastic polymer. The elastic polymer for the layer C-3 can be selected from the same elastomers as those which are to be used in the base material layer. That is, examples of the elastic polymer for the layer C-3 include polyurethane elastomer, polyurethane urea elastomer, polyurea elastomer, polyester elastomer and a synthetic rubber. Of these, polyurethane elastomer is preferred.

Specific examples of the polyurethane elastomer that is preferably used in the layer C-3 and the base material layer include polyurethane elastomers obtained by reacting a polyester diol having a molecular weight of 800 to 4,000, a polyether diol and a polycarbonate diol which are used alone or in combination, and an organic diisocyanate containing diphenylmethane 4,4'-diisocyanate as a main component together with a chain extender such as a low-molecular-weight diol, a diamine, hydrazine or a hydrazine derivative.

In the present invention, the layer C-3 formed from an elastic polymer is required to be porous. Further, preferably, a thin surface skin layer of the layer C-3 is present, and when the cross section thereof is viewed, the layer C-3 has a conical porosity structure in which tops of cones face the front surface side of the layer C-3. Further, the layer C-3 preferably has a vertical-hole-shaped structure in which vertical holes have a major length of 10 to 200 μm, preferably 30 to 100 μm. In the layer C-3 and the base material layer in the present invention, preferably, the elastic polymer has fine through holes. Owing to such porosity, the surface material can be a sheet that has strength but flexibility, and it can be further provided with high air permeability and moisture permeability.

The above sheet having the layer C-3 on one surface of the base material layer, for use in the present invention, can be obtained by treating the fibrous base material with an elastic polymer. For example, the fibrous base material is impregnated with a solution of the elastic polymer in an organic solvent, and then, a solution of the elastic polymer is coated on the surface thereof, followed by coagulation, whereby the above sheet can be obtained. Particularly, as a method for the above coagulation, it is preferred to employ a method in which the elastic polymer is coagulated so as to be porous. Such a method includes, for example, a wet coagulation method in which the fibrous base material is impregnated and/or coated with a solution of the elastic polymer in an organic solvent and then immersed in a non-solvent to the elastic polymer and then the elastic polymer is coagulated, and a special dry method in which a non-solvent to the elastic polymer is mixed with the solution of the elastic polymer in an organic solvent to prepare an emulsion and then the solvents are removed by evaporation.

Further, for finally forming the layer C-3 with a structure having fine through holes, it is particularly preferred to employ the wet coagulation method. In this case, it is effective to add, as a porosity-adjusting agent, an anionic, nonionic or cationic surfactant having hydrophilic groups to the organic solvent solution of the elastic polymer that is to be coagulated by the wet method. The surfactant preferably includes sodium sulfonate dialkyl succinate, polyoxyethylene-modified silicon and polyoxyethylene-modified alkylphenyl.

Properly, the layer C-3 formed on one surface of the base material layer has a thickness of 1 to 20 μm, preferably 2 to 15 μm.

The surface material of the present invention has a structure in which the layers C-1 and C-2 are formed on the surface of the layer C-3 of the above sheet formed of the layer C-3 and the base material layer. The above layers C-1 and C-2 are mainly formed from the elastic polymer, and the surface material has a characteristic feature in that the layer C-1 (outermost layer surface) is formed from the elastic polymer containing a tackifier.

The total thickness of the layers C-1 and C-2 is preferably 1 μm or greater, more preferably 3 to 20 μm, most preferably 5 to 10 μm. When the total thickness is less than 1 μm, the surface material is liable to have insufficient abrasion resistance. When the total thickness exceeds 20 μm, the number of fine pores necessary for water absorption properties is decreased, and the surface material is liable to be degraded in gripping characteristic when it is moistened.

In the total thickness of the layers C-1 and C-2, advantageously, the ratio of the layer C-1:layer C-2 is in the range of 2:8 to 4:6, preferably 3:7 to 5:5.

In the surface material of the present invention, the coating layer formed of the layers C-1, C-2 and C-3 is formed on one surface of the base material layer, and as a form, the surface of the coating layer may be a substantially flat and smooth surface or may be a surface having a great number of hills and valleys.

One of preferred embodiments of the surface material of the present invention is a surface material having a great number of hills and valleys shapes on its surface. The uneven in the surface material having a great number of hills and valleys on its surface will be specifically explained below.

In the surface material having a surface uneven, provided by the present invention, convexoconcave shapes having a valleys-and-hills height difference of at least 0.1 mm are present on the surface thereof, and the ratio of the total area of top portions of hills is 20 to 70% based on the area of the coating layer. Further, the valleys-and-hills height difference is preferably 0.15 to 1.2 mm, more preferably 0.2 to 1.0 mm. Further, the ratio of the total area of top portions of the hills to the area of the coating layer (surface material) is 20 to 70%, preferably 30 to 60%. The above area of the coating layer of the surface material refers to the area of the surface material per se. That is, it refers to the area of a projection image when the surface material is viewed toward its front surface side and differs from a surface area obtained by taking account of the hills and valleys present on the surface. The above top portion of hill (hill top portion) refers to a portion that is apart from the hill top by 1/10 of a distance from the top of the hill to the bottom of a valley when the hills and valleys are viewed toward the side surface of the surface material. The surface material of the present invention has the above uneven on the surface, so that it attains gripping characteristic and durability at high levels.

Further, in the surface material having a surface convexoconcave form, provided by the present invention, preferably, the hill are formed as independent hills for increasing the gripping characteristic. The hill top portions of the independent hill tops preferably have an average area of 0.5 to 7 $mm^2$, more preferably 1.5 to 4.0 $mm^2$. Further, the number of the hills per $cm^2$ is preferably approximately 5 to 100, and more preferably, it is 10 to 60 hills/$cm^2$.

The independent hills preferably have the form of a truncated cone in view of durability, and the top portion of each hill having the form of a truncated cone preferably has a diameter of 0.8 to 3.0 mm, more preferably 1.2 to 2.5 mm.

In the surface of the surface material, further, the top portion of each hill has the layers C-1 and C-2 formed of elastic polymers. The total thickness of the layers C-1 and C-2 is preferably 1 μm or more, more preferably 3 to 20 μm, most preferably 5 to 10 μm.

The elastic polymer for use in the layers C-1 and C-2 preferably has a 100% elongation stress of 30 to 150 kg/$cm^2$. For example, the above elastic polymer is most suitably a polyurethane elastomer. When the 100% elongation stress of the above elastic polymer is less than 30, the surface material has a low modulus and tends to be insufficient in abrasion resistance. When it exceeds 150 kg/$cm^2$, the surface material is excellent in abrasion resistance but is liable to have a low gripping characteristic. The 100% elongation stress of the elastic polymer is more preferably 40 to 100 kg/$cm^2$, most preferably 60 to 80 kg/$cm^2$.

Further, the elastic polymer for the layer C-2 preferably has high strength, and the elastic polymer for the layer C-1 preferably contains a component having a high friction coefficient.

The elastic polymer for forming the layer C-2 is preferably a polyurethane elastomer, and as a specific example thereof, there is a polyurethane elastomer obtained by reacting the following diol and diisocyanate together with a chain extender. That is, examples of the diol include polymer diols exemplified by polyether diols such as polyethylene ether glycol having a molecular weight of 1,000 to 3,000 and polytetramethylene glycol, carbonate diols such as polyhexamethylene carbonate diol and polytetramethylene carbonate diol and polyester diols such as polytetramethylene adipate diol and polyhexamethylene adipate diol, and these polymer diols may be used alone or in combination. Examples of the diisocyanate include alicyclic or aliphatic diisocyanates such as dicyclohexylmethane 4,4'-diisocyanate, 3,3,5-trimethyl-5-isocyanatemethylcyclohexyl isocyanate and hexamethylene diisocyanate, and aromatic diisocyanates typified by diphenylmethane-4,4'-diisocyanate. Further, examples of the chain extender include low-molecular-weight chain extenders such as ethylene glycol, butylene glycol, propylenediamine, butylenediamine, hydrazine, a hydrazine derivative, amino acid hydrazide, 3,3,5-trimethyl-5-aminomethylcyclohexylamine and diaminodicyclohexylmethane. Further, the diol component is preferably a polyether diol or polycarbonate diol, and in this case, the elastic polymer is improved in hydrolysis resistance, durability, and the like. Further, the diisocyanate is preferably an alicyclic or aliphatic diisocyanate, and the elastic polymer tends to be improved in resistance to discoloration. When such a polyurethane elastomer is used, the 100% elongation stress can be easily adjusted by adjusting the contents of the diisocyanate and the low-molecular-weight chain extender.

The elastic polymer for forming the layer C-1 is preferably selected from low-modulus polyurethane elastomers having a 100% elongation stress of 30 to 150 kg/$cm^2$ among the above polyurethane elastomers described as a elastic polymer for the layer C-2, more preferably selected from such low-modulus polyurethane elastomers having a 100% elongation stress of 40 to 120 kg/$cm^2$. When the 100% elongation stress is small, the surface material is improved in gripping characteristic but is liable to be degraded in abrasion resistance. On the other hand, when the 100% elongation stress is large, the surface material is improved in abrasion resistance but is liable to be degraded in gripping characteristic.

Further, the elastic polymer of the layer C-1 preferably contains a tackifier (gripping characteristic improving agent).

The tackifier includes a rosin resin and liquid rubbers, and these may be used alone or in combination. Of these, preferred are low-molecular-weight synthetic liquid rubbers having a molecular weight of 800 to 5,000, preferably 1,000 to 4,000, which come under the liquid rubbers. Particularly preferred are a low-molecular-weight polybutadiene, a low-molecular-weight acrylonitrile-butadiene copolymer, a low-molecular-weight polydicyclopentadiene, a low-molecular-weight styrene-butadiene copolymer, a low-molecular-weight chloroprene and a low-molecular-weight polystyrene. The content of the tackifier in the layer C-1 per 100 parts by weight of solid content of the elastic polymer is preferably 5 to 100 parts by weight, more preferably 10 to 85 parts by weight, most preferably 20 to 70 parts by weight. It is required to determine the optimum amount of the tackifier to be added, depending upon the touch required and the required level of the gripping characteristic. When the amount thereof is too large, the layer C-1 is liable to suffer a decrease in strength and to be poor in abrasion resistance. Further, the layer C-1 also preferably contains a luster adjusting agent such as silica, a pigment and a stabilizer, and the texture such as surface luster can be thereby adjusted.

In the surface material having a surface convexoconcave form, provided by the present invention, preferably, side surface portions between the top portions of the hills and bottom portions of the valleys have fine pores at a rate of at least 1,000 pores/cm$^2$. Further, the side surface portions more preferably have fine pores at a rate of at least 2,000 pores/cm$^2$, still more preferably at least 5,000 pores/cm$^2$. From the viewpoint of durability, the number of the above fine pores is preferably not more than 100,000/cm$^2$. Further, the fine pores preferably have a diameter of 0.5 to 50 μm. When the side portions of the surface material have a great number of fine pores as described above, the surface material can be improved in gripping characteristic at a moistened time without causing a decrease in durability.

The above hill top portion, a valley bottom portion and a side portion between them refer to a top portion that is distant from a hill top by 1/10 of a height difference between a hill top and a valley bottom, a bottom portion that is distant from a valley bottom by 2/10 of the height difference and a side portion that is present between them and ranges from 1/10 to 8/10 of the height difference when hills and valleys are observed toward a vertical cross section of the surface material.

In the surface material, preferably, fine pores exist on portions other than side portions as well. Preferably, the number of the pores on the valley and hill side surfaces is greater than the number of the fine pores on hill top portions. Further, the number of the fine pores on the hill top portions is preferably 80% or less, more preferably, 60% or less based on the number of the fine pores on the side portions. Further, preferably, the fine pores exist in bottom portions of the valleys, and the total number of the fine pores per the area of the coating layer is preferably at least 2,000 pores/cm$^2$. Further, from the viewpoint of durability, preferably, it is not more than 100,000 pores/cm$^2$. When such fine pores exist, water films on the surface can be absorbed at a moistened time, and the surface material can be improved in gripping characteristic at a moistened time.

Further, when the hill portions exist independently, the surface material is preferably a surface material in which each side portion excluding the top portion and the bottom portion has at least 50 fine pores having a diameter of 0.5 to 50 μm per hill portion on the surface thereof. From the viewpoint of soiling resistance, preferably, each side portion has not more than 5,000 fine pores.

Further, in the surface material, preferably, the fine pores on the side portions communicate with an inside of the surface material as through holes, and as far as the side portions are concerned, preferably, the number of the fine pores in shoulder portions close to the top portions is greater.

The surface material having the surface convexoconcave form, provided by the present invention, can be obtained by the method to be explained below. That is, the method comprises embossing a sheet having the base material layer and the layer C-3 formed of the porous elastic polymer on the surface of the base material layer with a die having a "valleys and hills" portion having a height difference of at least 0.1 mm, to form a sheet in which the total area of hill top portions is 20 to 70% based on the sheet area, and then applying the layer C-1 and the layer C-2 formed of elastic polymers on the hill top portions. The height difference of the valleys and hills portion of the die is preferably 0.2 to 1.5 mm, most preferably 0.3 to 1.0 mm.

The embossing is carried out with the die having a valleys and hills portion having a height difference of at least 0.1 mm, whereby side surface portions that form slopes of hills and valleys are elongated, so that fine pores can be formed through the surface of the skin layer. Further, the above die preferably has independent valley portions, and it is more preferably a die having an inverted form of truncated cones. With the die, the convexoconcave form can be formed on the surface of the sheet. The size of the hill top portions can be adjusted by adjusting the form of the die, and the height of the hills and valleys portion can be adjusted by adjusting the depth of the die and the pressure, temperature and time period during the embossing.

Further, concerning the embossing conditions, preferably, the sheet is pressed on the layer C-3 side at a temperature in the range of (SP−40)° C. to (SP+20)° C., more preferably (SP−20)° C. to (SP+5° C.), in which SP is a softening temperature of the elastic polymer of the layer C-3.

Further, preferably, the sheet is gravure-treated with an organic solvent containing a solvent for the porous elastic polymer of the skin layer before the embossing. For example, there is employed a method in which an organic solvent containing a solvent for the above elastic polymer forming the layer C-3 is applied to the sheet having the layer C-3 with a 50 to 200-mesh, preferably 70 to 100-mesh gravure roll, to dissolve the formed skin layer and to form fine pores. When the above method is employed, fine pores can be formed on the skin surface in advance, so that the number of the fine pores can be increased. Prior to the gravure treatment with an organic solvent, preferably, a solution containing the elastic polymer to form, for example, the layers C-2 or C-1 is not applied. That is because a layer of the applied elastic polymer inhibits the formation of the fine pores by embossing in the present invention, and because there is caused a problem that the applied elastic polymer is peeled off due to heat for the embossing.

For forming the layers C-1 and C-2 made of the elastic polymers on the top portions of the surface of the valleys and hills, there is employed a method in which solutions of the elastic polymers are respectively applied. Desirably, the above solutions are applied without clogging the fine pores formed on hill portions having the form of truncated cones. For this purpose, preferably, each solution is prepared to have a low concentration and a low viscosity, a finer gravure roll mesh is employed for the application, and the application amount for each is controlled to be small. That is, preferably, solutions of the elastic polymers for constituting the layers C-1 and C-2 in organic solvents having low boiling points are prepared, and the solutions are applied to top portions of the embossed hill portions and dried under dry heat. Further, it is preferred to employ a method in which gravure-coating is carried out at a clearance of 70 to 98% of the sheet thickness. When each solution is applied under the above conditions, the solutions of the elastic polymers may be applied to the top portions alone, and no solutions of the elastic polymers may be applied to the side surfaces and valleys. In the above manner, the solutions of the elastic polymers are applied to the top portions of the hill, so that the surface material can be improved in surface abrasion resistance and can be formed as a surface material to which soiling does not easily adhere.

Further, for the layers C-1 and C-2, the solutions of the elastic polymers in organic solvents having low boiling points can be consecutively applied by a gravure roll method, a spray method, or the like. That is, the layer C-2 is formed, and then, the layer C-1 is formed thereon. In this case, large valleys and hills are formed on the surface, so that the fine pores formed on the side surfaces are not easily clogged as compared with the top portions and valley portions.

Other embodiment of the present invention is directed to a surface material for balls, in which the surface of a coating layer has a substantially flat and smooth surface. The above substantially flat and smooth surface means a surface having no valleys and hills unlike the above surface material having a great number of valleys and hills. The flat and smooth surface can be any surface so long as it is substantially flat, and fine patterns and fine valleys and hills may be slightly present.

The surface material having the above flat and smooth surface is constituted in the order of layer C-1/layer C-2/layer C-3/base material layer. The components and thickness for constituting of the layers C-1, the layer C-2, the layer C-3 and the base material layer are not specially different from those explained with regard to the above surface material having the uneven surface, so that a detailed explanation thereof will be omitted.

The surface material having the flat and smooth surface can be produced by preparing the base material layer having the layer C-3 on one surface and consecutively forming the layers C-2 and C-1 on the surface of the layer C-3 according to the method explained with regard to the above surface material having the convexoconcave surface. Particularly, a tackifier is incorporated into the layer C-1, whereby there can be obtained the surface material excellent in gripping characteristic and abrasion resistance.

In the surface material having the flat and smooth surface, preferably, the layers C-1 and C-2 have fine through holes starting from the front surface side and reaching the layer C-3, and the through holes exist on the surface at a rate of 500 or more through holes/$cm^2$. More preferably, the coating layer has fine through holes starting from the front surface side and reaching the base material layer, and the through holes exist on the surface at a rate of 1,000 or more through holes/$cm^2$. As a method and means of forming the above great number of the fine through holes, there can be employed a method and means similar to those explained with regard to the above surface material having the uneven surface.

Further, the surface material for balls, provided by the present invention, preferably has a surface wet friction coefficient of 1.5 to 4.5. Further, it is more preferably 1.8 to 4.0, further preferably 2.0 to 3.5, and particularly preferably 2.3 to 3.0. When the wet friction coefficient is low, the surface material is slippery and is liable to be degraded in gripping characteristic. When it is high, the surface material has intense sticking nature and is liable to be degraded in touch and soiling resistance. Further, the surface material preferably has a dry friction coefficient of 1.5 to 4.5, and further, it preferably has a dry friction coefficient in the range equivalent to the range of the wet friction coefficient.

Further, when the surface water absorption degree of the surface material of the present invention is indicated as a water absorption time period, the water absorption degree measured by a method to be described later is preferably 500 seconds or less. The water absorption time period is more preferably 300 seconds or less, most preferably 200 seconds or less. When the surface material exhibits the above short time period of water absorption, no water film is left on the surface since a water film is absorbed through surface pores, so that the surface material does not decrease in the characteristic of grapping balls even when it is wet with sweat.

Further, the contact angle of the surface material to water is preferably 90 degrees or less. For this purpose, the surface of opening portions and the coating layer formed of the elastic polymers can be imparted with hydrophilic nature. It is therefore preferred to allow a substance that exhibits hydrophilic surface activity to be present on and inside the coating layer formed of the elastic polymers. For example, an anionic surfactant, a nonionic surfactant having an HLB of 10 or more, or the like can be incorporated. Alternatively, when the coating layer is formed of polyurethane elastomer, the polyurethane elastomer is preferably a hydrophilic polyurethane elastomer containing a polyether diol component having polyoxyethylene glycol as a segment.

The thus-obtained surface material for balls, provided by the present invention, can be formed into balls for games by attaching it to bodies inflated with compressed air, and they can be suitably used for basketball, rugby ball, American football, handball, volleyball, baseball, and the like.

Further, the surface material for balls, provided by the present invention, can be also suitably used for gloves, for example, for golfing gloves, fishing gloves and other sports gloves.

EXAMPLES

The present invention will be explained in detail with reference to Examples hereinafter. The present invention shall not be limited to the scope of Examples, and part and % stand for part by weight and % by weight unless otherwise specified.

Concerning measurement items in the present invention, measurements were made as follows.

(1) Elongation Stress

A 0.1 mm thick film that was a JIS K 6301 No. 2 dumbbell test piece was used as a sample, and the test piece was measured with a constant-speed elongation tester under a condition of 100%/minute as an elongation rate.

(2) Dry Friction Coefficient

While a surface material (width 2.5 cm, length 5 cm) whose moisture had been adjusted under conditions of 23° C. as a temperature and 60% as a relative humidity for 24 hours was placed in contact with the surface of a flat stainless steel plate, the surface material was allowed to move at a rate of 2 m/minute under a load of 500 g, and the surface material was measured for a frictional force (F) to determine a dry friction coefficient $\mu d=F/500$. The frictional force (F) was an average value during the movement of the test piece.

(3) Wet Friction Coefficient

A test piece made of a surface material (width 2.5 cm, length 5 cm) was immersed in water at 23° C. for 24 hours, and then water adhering to the surface thereof was wiped off with tissue paper. While the test piece was placed in contact with the surface of a flat stainless steel plate, the surface material was allowed to move at a rate of 2 m/minute under a load of 500 g, and the surface material was measured for a frictional force (F) (unit; g) to determine a wet friction coefficient μw=F/500. The frictional force (F) was an average value during the movement of the test piece.

(4) Abrasion Resistance

Measurements were made according to JIS L1079 6.15.3 C method (Taber abrasion test). A truck wheel having 280-mesh sand paper attached thereto was used as such, and a test piece was abraded 100 times under a load of 500 g. Then, the test piece was evaluated for a surface damage state on the basis of the following ranks.

Rank 5: There is no or little change in color and such a change does not show.

Rank 4: A surface skin layer alone is damaged, and there was no practical problem in appearance.

Rank 3: A porous coating layer is partly damaged (a tolerable limit to practical use).

Rank 2: A porous coating layer is considerably damaged, and the fiber of a base material layer is partly exposed.

Rank 1: A base material layer is considerably damaged, and a fiber, etc., are exposed.

(5) Number and Size of Pores in Top Portions, Bottom Portions and Side Portions of Hills and Valleys When hills and valleys exist on the surface of a surface material, the hill top portion, a valley bottom portion and a side portion between them refer to a portion that is distant from the top of a hill by 1/10 of a height difference between the top of the hill and the bottom of the valley, a portion that is distant from the bottom of a valley by 2/10 of the above height difference and a portion which is between them and ranges from the portion that is distant from the top of the hill by 1/10 of the above height difference to the portion that distant from the top of the hill by 8/10 of the above height difference, when the hills and valleys are observed toward the side surface of the surface material.

In Examples, pores in hills and valleys were counted or measured for sizes, and an average value was multiplied by a number of hills per $cm^2$ for calculations as follows.

Concerning the number and size of pores on the top portion of a hill, a photograph of a surface was taken through a scanning electron microscope at a magnification of 200 diameters, pores were counted and measured for sizes with regard to top portions of five different hills to determine numbers of pores having a diameter of 0.5 to 50 μm, and an average value thereof was calculated and shown.

Concerning the number and size of pores in valley bottom portions, a bottom portion of a surface material were brought into focus, a photograph was taken through a scanning electron microscope at a magnification of 200 diameters, and pores were counted and measured for sizes, to determine a number of pores having a diameter of 0.5 to 50 μm and an average value thereof. The obtained data was converted to value per $cm^2$ and a value per $cm^2$ is shown. Further, when independent hills are present, measurements were made with regard portions near five different hill portions, and an average value was calculated.

Concerning the number and size of pores on side surface portions, the side surface is a side surface of a three-dimensional hill portion, so that the side surface came out of focus. For preventing the "out of focus", therefore, a hill portion was vertically cut into 4 equivalent portions or more, and photographs of the surfaces of side portions of convex portions were taken through a scanning electron microscope at a magnification of 200 diameters and used. Pores were counted and measured for sizes with regard to hill portions in five different points, and pores having a diameter of 0.5 to 50 μm were counted and an average thereof is shown.

(6) Total Thickness of Layers of Surface Material

A surface material was measured for total thickness with a spring dial gauge under a load of 150 $g/cm^2$.

(7) Average Thickness of Coating Layer (C-1, C-2) on Front Surface Side

Concerning the thickness measurement of coating layer (C-1, C-2) on the front surface side, a photograph was taken through a scanning electron microscope at a magnification of 2,500 to 3,000 diameters, and the coating layer was measured for an average thickness. When a plurality of layers were discriminatable, each layer was measured for a thickness.

(8) Soiling Resistance

A ball for a game, prepared from a surface material, was used in 10 games, and then the ball was evaluated for a soiled condition as follows.

Grade 5: A ball is free of soiling and excellent.

Grade 4: A ball has a slight change in color but has no problem.

Grade 3: A ball is soiled but the soiling is tolerable for practical use.

Grade 2: A ball is soiled to some degree.

Grade 1: A ball is soiled to a great degree, and the soling is hard to remove by wiping.

(9) Gripping Characteristic and Touch

Game balls prepared from a surface material were brought into a dry state and a moistened state obtained by wetting the balls with water, and players were allowed to evaluate balls. The evaluations were made on the basis of five grades. Grade 5 represents "excellent", grade 3 represents a tolerable range in practical use, and grade 1 represents "defective".

(10) Surface Water Absorption Degree

A water drop (0.02 cc) was dropped on the surface (hill top portions when hills and valleys existed) of a surface material from a position 10 mm high from the surface with a burette, and a time period to take immediately from the dropping to water absorption was measured.

(11) 40% Compression Stress

A test sheet (10 cm×10 cm) was measured for a thickness with a compression modulus tester while a load was exerted in the thickness direction of the test sheet. A thickness under a load of 100 $g/cm^2$ was taken as a standard, and a load when the thickness was decreased by 40% was measured. The obtained data was converted to a load per $cm^2$, and the thus-obtained value was taken as a 40% compression stress.

Example 1

<Preparation of Sheet-Shaped Material Formed of Base Material Layer and a Coating Layer (C-3)>

Nylon 6 and a low-density polyethylene were mixed at a ratio of 50/50, the mixture was melted and mixed with an extruder, the mixture was spun at 290° C. into fibers, the fibers were stretched, applied oil and the fibers were cut to obtain 51 mm long fibers having a size of 5.5 dtex. The fibers were passed through the steps of carding, cross-wrapping, needling and calendaring to give an intertwined fibrous base material having a weight of 480 $g/m^2$, a thickness of 1.6 mm and an apparent density of 0.3 $g/cm^3$.

On the other hand, for a elastic polymer to be coagulated so that it was to be porous, a 50/50 mixture diol containing polytetramethylene ether glycol having a molecular weight of 2,050 and polydiethylene adipate having a molecular weight of 1,950, diphenylmethane-4,4'-diisocyanate and ethylene glycol were allowed to react in dimethylformamide as a solvent, to obtain a polyurethane elastomer solution (1) (solid content 20%) having a 100% elongation stress of 60 kg/cm$^2$ and a thermal softening temperature of 180° C.

100 Parts of the above polyurethane elastomer solution, 42 parts of dimethylformamide, 0.5 part of a porosity adjusting agent (polyoxyethylene-modified silicon: FG-10, supplied by Matsumoto Yushi Sekiyaku Co., Ltd.) and a solution of 0.5 part of a brown pigment (polyurethane concentration 14%) were mixed, and the mixture was used as a elastic polymer solution (immersing solution) for impregnating a base material.

Further, 100 parts of the above polyurethane elastomer solution, 33 parts of dimethylformamide, 0.5 parts of a porosity adjusting agent, 0.5 part of a low-molecular-weight cellulose propionate (FG-220, supplied by Matsumoto Yushi Seiyaku Co., Ltd.) and a solution of 0.5 part of a brown pigment (polyurethane concentration 15%) were mixed, and the mixture was used as a elastic polymer solution for a coating layer (C-3).

Then, the fibrous base material was immersed in the immersing solution for impregnating a base material, and squeezed so as to have a thickness that was 90% of the base material thickness. Then, before the base material was restored from its compression, the elastic polymer solution for a coating layer (C-3) was applied at a rate of 180 g/m$^2$ as a solid content, and the elastic polymers were wet-coagulated in water containing 10% of dimethylformamide at 40° C., followed by washing with water and drying. The thus-obtained sheet was repeatedly compressed and relaxed in hot toluene at 90° C., to remove a polyethylene component in the fibers by extraction, whereby there was prepared a sheet-shaped material using, as a fibrous base material, very fine fibers having a size of 0.003 denier and having a elastic polymer coating layer (C-3). The coating layer had a tear-drop-shaped porous structure having a length of 50 μm from a front surface.

<Preparation of Surface Material (1)>

The surface of the above sheet-shaped material was pressed with an embossing apparatus fitted with an embossing roll (roll surface temperature 160° C.), to obtain a sheet-shaped material having independent hill portions. As the embossing roll, there was prepared and used a roll heatable with a heating medium, the roll having a die that had 24 independent valley portions/cm$^2$, each valley portion having the form of a truncated cone, and which was to transferred to the sheet-shaped material to form hill portions, each hill portion having a top portion having a maximum diameter of 1.8 mm, a bottom portion having a maximum diameter of 2.3 mm and a truncated cone height of 0.6 mm.

The embossed sheet-shaped material had hill portions having the form of a truncated cone each, and an average of 2,000 fine through holes having a diameter of 1 to 20 μm were present through the side surfaces of each hill portion. Further, the through holes had a distribution in which more through holes were distributed on each side surface on hill portion sides of side surfaces.

Then, a polymer diol prepared by mixing polyoxyethylene glycol (molecular weight 2,020), polytetramethylene ether glycol (molecular weight 2,000) and polyhexamethylene carbonate diol (molecular weight 1,980) in a molar ratio of 2:4:4 and 3,3,5-trimethyl-5-isocyanatemethylcyclohexyl isocyanate were allowed to react in an excess amount of the isocyanate, to prepare a prepolymer, and the prepolymer was dissolved in dimethylformamide so as to have concentration of 40%. Then, a solution of 3,3,5-trimethyl-5-aminomethylcyclohexylamine in toluene was dropwise added for a reaction to extend a polymer chain, whereby a polyurethane elastomer for a coating layer (C-2) was obtained, the polyurethane elastomer having a concentration of 30% and a viscosity of 1,000 poise at 25° C. A 0.15 mm thick film prepared from the above polyurethane elastomer by removing the solvents was measured for a 100% elongation stress to show 110 kg/cm$^2$.

100 Parts of the above polyurethane elastomer, 200 parts of a solvent mixture containing methyl ethyl ketone:isopropyl alcohol:dimethylformamide=5:4:1 and 1 part of a brown pigment were mixed, to prepare a coating solution (1) for a coating layer (C-2), the coating solution having a polyurethane elastomer concentration of 10.3% and a viscosity of 150 centipoise (25° C.).

The above coating solution (1) for a coating layer (C-2) was applied to the above embossed sheet-shaped material having independent hills portions with a gravure coater fitted with a 200-mesh gravure roll with the application gap of the roll being adjusted to be 90% of the sheet thickness, to give a sheet-shaped material having a coating layer (C-2). The coating layer (C-2) was applied onto only the hill top portions of the sheet-shaped material, and the through holes present on the side portions of the hill portions were not clogged.

Then, for a elastic polymer for a coating layer (C-1), a polymer diol prepared by mixing polyoxyethylene glycol (molecular weight 2,020), polytetramethylene ether glycol (molecular weight 2,000) and polyhexamethylene carbonate diol (molecular weight 1,980) in a molar ratio of 3:3:4 and 3,3,5-trimethyl-5-isocyanatemethylcyclohexyl isocyanate were allowed to react in an excess amount of the isocyanate, to prepare a prepolymer, and the prepolymer was dissolved in dimethylformamide so as to have a concentration of 40%. Then, a solution of 3,3,5-trimethyl-5-aminomethylcyclohexylamine in toluene was dropwise added for a reaction to extend a polymer chain, whereby a polyurethane elastomer for a coating layer (C-1) was obtained, the polyurethane elastomer having a concentration of 30% and a viscosity of 1,000 poise at 25° C. A 0.15 mm thick film prepared from the above polyurethane elastomer by removing the solvents was measured for a 100% elongation stress to show 100 kg/cm$^2$.

100 Parts of the above polyurethane elastomer, 343 parts of a solvent mixture containing methyl ethyl ketone:isopropyl alcohol:dimethylformamide=5:4:1, 0.6 part of a brown pigment, 0.3 parts of silica and 15 parts of a tackifier (polybutadiene having a molecular weight of 2,000) were mixed and dissolved, to prepare a coating solution (2) for a coating layer (C-1), the coating solution having a concentration of 10.8% and a viscosity of 150 centipoises.

The above coating solution (2) for a coating layer (C-1) was applied to the above sheet-shaped material having the coating layers (C-2, C-3) with a gravure coater fitted with a 200-mesh gravure roll with the application gap of the roll being adjusted to be 90% of the sheet thickness, to give a sheet-shaped surface material having a front surface layer formed of a plurality of coating layers (C-2) and (C-1) on the hill portions of the sheet-shaped material. The above front surface layer was coated only on the top portions of the hill portions, and the through holes present on side surfaces of the hill portions were not clogged. The number of the through holes per cm$^2$ of the sheet area was approximately 36,000/cm$^2$.

The top portions of the hill portions on the front surface had a diameter of 1.64 mm, an area of 2.1 mm$^2$ and a height of 0.32 mm. The ratio of area of the top portions of the hill based on the sheet area was 50%, and the through holes on side surfaces of the hills and valleys per cm$^2$ of the sheet area was approximately 36,000/cm$^2$ (1,500 through holes×24/cm$^2$). The thus-obtained surface material (1) was measured for properties, and Table 1 shows the results.

Further, the obtained surface material was bonded to bodies inflated with air for basketball, and the balls were tested, to show that they were excellent in the touch, that they were not easily slippery even if hands were sweated and that they were also excellent in abrasion resistance of the surface.

Comparative Example 1

A sheet-shaped material was embossed under the same conditions as those in Example 1, to give a sheet-shaped material having independent hill portions. The above sheet-shaped material was similar to the surface material of Example 1 except that its front surface had no coating layers (C-1, C-2). The thus-obtained sheet-shaped material was excellent in the touch and gripping characteristic. However, it was poor in the abrasion resistance of its front surface, was easily soiled and was insufficient as a surface material for balls for ball games.

Table 1 shows measurement results of the sheet-shaped material.

Comparative Example 2

The same sheet-shaped material as that obtained in Example 1 was provided without embossing it. The coating solutions (1) and (2) for coating layers (C-2) and (C-1) were applied to the front surface of the sheet-shaped material under the same conditions as those in Example 1, followed by embossing under the same conditions as those in Example 1, while the step of embossing was different.

In the thus-obtained sheet-shaped material, coating layers (C-2, C-1) adhered to an embossing roll by being melted, and they were peeled off and dropped off the front surface thereof. Hill portions having the form of a truncated cone each was poor in formability, and openings of through holes were not formed, either. Table 1 shows measurement results of the sheet.

Example 2

A solvent mixture containing dimethylformamide:methyl ethyl ketone=7:3 was applied to the front surface of the same sheet-shaped material having a coating layer (C-3) as that prepared in Example 1 with a 110-mesh gravure roll, to dissolve and open a skin layer of the elastic polymer present on the front surface, whereby a flat and smooth sheet having through holes was obtained. The front surface of the flat and smooth sheet had 1,600/cm$^2$ of holes having an average diameter of 15 μm.

The above flat smooth sheet having openings was embossed with the same embossing apparatus as that used in Example 1 under the same conditions as those in Example 1, to form a sheet-shaped material having independent hill portions having the form of a truncated cone each. Holes on the surfaces of the side surface side of the hill portions of the sheet-shaped material were extended so as to have a major diameter of 30 μm, and holes on the top portions and valley portions remained while they had a slightly smaller diameter. The number of the existing holes per hill portion was 820.

Then, a coating layer (C-2) was formed on the sheet-shaped material having independent hill portions from the same coating solution (1) as the coating solution (1) for a coating layer (C-2) in Example 1 under the same conditions as those in Example 1 except that the gravure coating was carried out twice. Then, the same coating solution (2) as the coating solution (2) for a coating layer (C-1) in Example 1 was applied under the same conditions as those in Example 1, to give a sheet-shaped surface material (2) having coating layers. The number of through holes per cm$^2$ of the sheet area was approximately 20,000/cm$^2$ (820 through holes×24/cm$^2$). The top portions of the hill portions thereof had an average diameter of 1.6 mm, an area of 2 mm$^2$ and a height of 0.29 mm. The ratio of the area of top portions of the hill portions based on the sheet area was 50%, and the number of the holes on side surface portions of the hills and valleys per cm$^2$ of the sheet area was approximately 11,000/cm$^2$. Table 1 shows measurement results of the surface material (2).

Balls were prepared from the thus-obtained surface material and evaluated in the same manner as in Example 1. As a result, the balls were excellent particularly in water absorption capability and were also excellent in the touch.

Example 3

A surface material was prepared in the same manner as in Example 2 except that the number of times of the gravure-application of the coating solution (1) for a coating layer (C-2) used in Examples 1 and 2 was changed from twice to three times. The number of through holes per cm$^2$ of the sheet area was approximately 16,000/cm$^2$ (680 through holes×24/cm$^2$). The top portions of the hill portions thereof had a height of 0.29 mm. The ratio of the area of top portions of the hill portions based on the sheet area was 50%, and the number of the holes on side surface portions of the hills and valleys per cm$^2$ of the sheet area was approximately 11,000/cm$^2$. Table 1 shows measurement results of the surface material (3).

Balls were prepared from the thus-obtained surface material and evaluated in the same manner as in Example 2. As a result, the balls were excellent particularly in surface abrasion resistance and were also excellent in the touch and water absorption capability.

Example 4

A sheet-shaped surface material (4) was prepared under the same conditions as those in Example 2 except that the coating solution (2) for a coating layer (C-1) used in Examples 1 and 2 was replaced with a coating solution (3) that was prepared by mixing a polyurethane elastomer (100% elongation stress 60 kg/cm$^2$) containing polycarbonate glycol, hexamethylene diisocyanate and isophoronediamine as main components with 15%, based on the weight of the polyurethane elastomer solid content, of a liquid rubber (low-molecular-weight acrylonitrile-butadiene copolymer) and dissolving the mixture in a solvent mixture containing methyl ethyl ketone:toluene=3:7, the coating solution (3) having a concentration of 10% and a viscosity of 150 centipoises (25° C.).

Further, the above surface material was immersed in a 1.0% aqueous solution of a hydrophilic surfactant sodium dioctylsulfosuccinate, squeezed and dried. The thus-obtained surface material had a water absorption degree of 180 seconds and was highly absorptive of water, and it was also excellent in the tough and gripping characteristic and further was excellent in surface abrasion resistance in practical use. The number of through holes per cm$^2$ of the sheet area was approximately 19,000/cm$^2$ (810 through holes×24/cm$^2$). The top portions of the hill portions thereof had a height of 0.30 mm. The ratio of the area of top portions of the hill portions based on the sheet area was 50%, and the number of the holes on side surface portions of the hills and valleys per cm$^2$ of the sheet area was approximately 11,000/cm$^2$. Table 1 shows measurement results of the surface material.

Example 5

A sheet-shaped surface material (5) was prepared under the same conditions as those in Example 1 except that the coating solution (2) for a coating layer (C-1) used in Example 1 was replaced with a coating solution (4) that was prepared by mixing the polyurethane elastomer with 60 parts, per 100 parts of the polyurethane elastomer, of a low-molecular-weight polycyclopentadiene resin having a molecular weight of 3,000 in place of the polybutadiene in the above coating solution (2).

The thus-obtained surface material was excellent in both abrasion resistance and gripping characteristic. The number of through holes per cm$^2$ of the sheet area was approximately 35,000/cm$^2$ (1,450 through holes×24/cm$^2$). The top portions of the hill portions thereof had a height of 0.32 mm. The ratio of the area of top portions of the hill portions based on the sheet area was 50%, and the number of the holes on side surface portions of the hills and valleys per cm$^2$ of the sheet area was approximately 35,000/cm$^2$. Table 1 shows measurement results of the surface material.

TABLE 1

| Items | Ex. 1 | Ex. 2 | Ex. 3 | Ex. 4 | Ex. 5 | CEx. 1 | CEx. 2 |
|---|---|---|---|---|---|---|---|
| Surface material thickness mm | 1.40 | 1.42 | 1.40 | 1.42 | 1.40 | 1.40 | 1.40 |
| Number of holes of hills and valleys | | | | | | | |
| Top portion | 0 | 240 | 40 | 250 | 0 | 0 | 0 |
| Side portion | 1500 | 460 | 440 | 440 | 1450 | 560 | 0 |
| Valley bottom portion | 0 | 120 | 200 | 120 | 0 | 0 | 0 |
| Average diameter of holes of hills and valleys | | | | | | | |
| Top portion μm | — | 1.8 | 1.0 | 2.0 | — | — | — |
| Side portion μm | 2.0 | 4.8 | 4.8 | 5.0 | 2.0 | 3.1 | — |
| Bottom portion μm | — | 2.3 | 2.1 | 2.3 | — | — | — |
| Average thickness of surface layer (total of coating layers (C-1) and (C-2)), mm | 3.0 | 4.6 | 9.5 | 4.5 | 3.0 | Nil | Dropped off |
| 100% elongation stress of PU | | | | | | | |
| Coating layer (C-2) kg/cm$^2$ | 110 | 110 | 110 | 110 | 110 | 110 | 110 |
| Coating layer (C-1) kg/cm$^2$ | 100 | 100 | 100 | 60 | 100 | 100 | 100 |
| Surface material | | | | | | | |
| Surface water absorption degree, second | 300 | 300 | 280 | 180 | 280 | 600 | >1000 |
| Dry friction coefficient | 2.4 | 2.6 | 2.3 | 3.8 | 2.5 | 4.5 | 2.1 |
| Wet friction coefficient | 2.0 | 1.8 | 1.7 | 2.2 | 1.9 | 3.8 | 1.9 |
| Abrasion resistance, Rank | 4 | 5 | 5 | 3 | 4 | 2 | 4 |
| Soiling resistance, Grade | 4 | 4 | 5 | 4 | 4 | 2 | 3 |
| Touch, grade | 4 | 4 | 4 | 4 | 4 | 4 | 3 |
| Dry gripping characteristic, Grade | 4 | 4 | 4 | 4 | 4 | 3 | 3 |
| Wet gripping characteristic, Grade | 4 | 4 | 4 | 4 | 4 | 3 | 3 |

Ex. = Example,
CEx. = Comparative Example

Example 6

<Preparation of Sheet-Shaped Material Formed of Base Material Layer and Coating Layer (C-3)>

Nylon 6 and a low-density polyethylene were mixed at a ratio of 50/50, the mixture was melted and mixed with an extruder, the mixture was spun at 290° C. into fibers, the fibers were stretched, applied oil, and the fibers were cut to obtain 51 mm long fibers having a size of 5.5 dtex. The fibers were passed through the steps of carding, cross-wrapping, needling and calendaring to give an intertwined fibrous base material having a weight of 400 g/m$^2$, a thickness of 1.6 mm and an apparent density of 0.25 g/cm$^3$.

On the other hand, for a elastic polymer to be coagulated so that it was to be porous, there was used the same polyurethane elastomer solution (1) (solid content 20%) having a 100% elongation stress of 60 kg/cm$^2$ and a thermal softening temperature of 180° C., as that used for the sheet-shaped material in Example 1. 100 Parts of the above polyurethane elastomer solution, 150 parts of dimethylformamide, 0.5 part of a porosity adjusting agent (polyoxyethylene-modified silicon: FG-10, supplied by Matsumoto Yushi Sekiyaku K.K.) and a solution of 0.5 part of a brown pigment (PU concentration: 8%) were mixed, and the mixture was used as a elastic polymer solution (immersing solution) for impregnating a base material.

Further, 100 parts of the above polyurethane elastomer solution, 54 parts of dimethylformamide, 0.5 parts of a porosity adjusting agent, 0.5 part of a low-molecular-weight cellulose propionate (FG-220, supplied by Matsumoto Yushi Seiyaku K.K.) and a solution of 0.5 part of a brown pigment (PU concentration: 13%) were mixed, and the mixture was used as a elastic polymer solution for a coating layer (C-3).

Then, the fibrous base material was immersed in the immersing solution for impregnating a base material, and squeezed so as to have a thickness that was 90% of the base material thickness. Then, before the base material was restored from its compression, the elastic polymer solution for a coating layer was applied at a rate of 180 g/m$^2$ as a solid content, and the elastic polymers were wet-coagulated in water containing 10% of dimethylformamide at 40° C., followed by washing with water and drying. The thus-obtained sheet was repeatedly compressed and relaxed in hot toluene at 90° C., to remove a polyethylene component in the fibers by extraction, whereby there was prepared a sheet-shaped material using, as a fibrous base material, very fine fibers having a size of 0.003 dtex and having a elastic polymer coating layer (C-3). The coating layer had a teardrop-shaped porous structure having a length of 50 μm from a front surface.

<Preparation of Surface Material (6)>

A solvent mixture containing dimethylformamide:methyl ethyl ketone=7:3 was applied to the front surface of the above sheet-shaped material with a 110-mesh gravure roll, to dissolve and open a skin layer of the elastic polymer present on the surface, whereby a flat and smooth porous sheet was obtained. The above flat and smooth sheet had a front surface having 1,800 holes/cm$^2$, the holes having an average diameter of 15 μm. The above front surface was embossed with an embossing roll having pattern of blood vessels at 140° C., to give a sheet-shaped material having a smooth appearance.

Further, the same coating solution (1) (concentration 10.3%) for a coating layer (C-2) as that used in Example 1 was applied to the sheet-shaped material having a smooth appearance with a gravure coater fitted with a 200-mesh gravure roll with the application gap of the roll being adjusted to be 90% of the sheet thickness, to give a sheet-shaped material having a coating layer (C-2).

Then, the same coating solution (2) (concentration 10.8%) for a coating layer (C-1) as that used in Example 1 was applied to the above sheet-shaped material having the coating layers (C-2, C-3) with a gravure coater fitted with a 200-mesh gravure roll with the application gap of the roll being adjusted to be 90% of the sheet thickness, to give a sheet-shaped surface material (6) having a front surface layer formed of a plurality of coating layers (C-2) and (C-1) on the coating layer (C-3).

The above surface material had a 40% compression stress of 1.0 kg/cm$^2$. The front surface of this smooth sheet had 680 holes/cm$^2$, the holes having an average diameter of 5.2 μm, and the coating layers (C-2) and (C-1) as a front layer had a total thickness of 3.0 μm. The thus-obtained surface material was measured for properties, and Table 2 shows the results.

Further, the obtained surface material was bonded to bodies inflated with air for volleyball, and the balls were tested, to show that they caused no or little impact in passing them, that they were excellent in the touch, that they were not easily slippery even if sweat adhered thereto and that they were also excellent in surface abrasion resistance.

Comparative Example 3

A sheet-shaped material having a smooth appearance was obtained in the same manner as in Example 6 except that it was not provided with surface coating layers (C-1, C-2) formed in Example 6. This material was poor in surface abrasion resistance and was easily soiled, so that it was insufficient as a surface material for balls for ball games. Table 2 shows measurement results of the sheet-shaped material.

Example 7

A sheet-shaped material was prepared in the same manner as in Example 6 except that the immersion solution (PU concentration: 8%) for immersing a base material, which contained a polyurethane elastomer having a 100% elongation stress of 60 kg/cm$^2$, was replaced with an immersion solution (solid content: 13%) containing a polyurethane elastomer having a 100% elongation stress of 90 kg/cm$^2$, and that the elastic polymer solution for a coating layer, which had a PU concentration of 13%, was replaced with a elastic polymer solution having a PU concentration of 15%.

The thus-obtained surface material was excellent in abrasion resistance and soiling resistance. Table 2 shows measurement results of the sheet-shaped material.

Example 8

A sheet-shaped surface material was prepared under the same conditions as those in Example 6 except that the coating solution (2) for a coating layer (C-1) used in Example 6 was replaced with the same coating solution (4) in Example 5 as that which was prepared by mixing the polyurethane elastomer with 60 parts, per 100 parts of the polyurethane elastomer, of a low-molecular-weight polydicyclopentadiene resin having a molecular weight of 3,000.

The thus-obtained surface material (8) had a 40% compression stress of 0.92 kg/cm$^2$. The front surface of this smooth sheet had 700 holes/cm$^2$, the holes having an average diameter of 5.5 μm, and the coating layers (C-2) and (C-1) as a front layer had a total thickness of 3.2 μm. The surface material was excellent in both abrasion resistance and gripping characteristic. Table 2 shows measurement results of the surface material.

Example 9

The front surface of the thus-obtained sheet-shaped material was pressed with an embossing apparatus fitted with an embossing roll at a roll surface temperature of 160° C., to give a sheet-shaped material having independent hill portions. As the embossing roll, there was prepared and used a roll heatable with a heating medium, the roll having a die that had 24 independent valley portions/cm$^2$, each valley portion having the form of a truncated cone, and which was to transferred to the sheet-shaped material to form hill portions, each hill portion having a top portion having a maximum diameter of 1.8 mm, a bottom portion having a maximum diameter of 2.3 mm and a truncated cone height of 0.6 mm.

The embossed sheet-shaped material had hill portions having the form of a truncated cone each, and an average of 2,000 through holes having a diameter of 1 to 20 μm were present through the side surfaces of each hill portion. Further, the through holes had a distribution in which more through holes were distributed on each side surface in shoulder portions close to the top portions of side surfaces.

The same coating solution (1) for a coating layer (C-2) and the same coating solution (2) for a coating layer (C-3) as those used in Example 6 were consecutively applied in the same manner as in Example 6, to obtain a sheet-shaped surface material having a plurality of front surface layers (thickness 3 μm) formed of coating layers (C-2) and (C-1) on the hill portions of the coating layer (C-3). The above front surface layers (C-2) and (C-1) were applied only to top portions of the hill portions of the surface material, and the through holes present through the side surface portions of the hill portions were not clogged.

The above surface material had a 40% compression stress of 1.0 kg/cm$^2$. The top portions of the hill portions had a diameter of 1.64 mm, an area of 2.1 mm$^2$ and a height of 0.32 mm each. The ratio of the area of top portions of the hill portions based on the sheet area was 50%, and the number of the holes on side surface portions of the hills and valleys per cm$^2$ of the sheet area was approximately 30,000/cm$^2$. The top portions and valley bottom portions of the hill portions having the form of a truncated cone had no through holes, and 1,200 through holes having an average diameter of 2.0 μm were present only on the surface of the side surface portion of each hill portion. The thus-obtained surface material was measured for properties, and Table 2 shows the results.

Example 10

A solvent mixture containing dimethylformamide:methyl ethyl ketone=7:3 was applied to the surface of the same sheet-shaped material as that obtained in Example 9 with a 110-mesh gravure roll in the same manner as in Example 6, to dissolve and open a skin layer of a elastic polymer present on the surface, whereby a flat and smooth porous sheet was obtained. The surface of the above flat and smooth sheet had 1,600 holes/cm$^2$, the holes having an average diameter of 15 μm.

The above flat and smooth sheet having the holes was embossed with the same embossing apparatus as that used in Example 9 under the same conditions as those in Example 9, to form a sheet-shaped material having independent hill portions having the form of a truncated cone each. Holes on the surfaces of the side surface sides of the hill portions of the sheet-shaped material were extended, and the holes on the top portions and valley portions remained while they had a slightly smaller diameter.

Then, a sheet-shaped surface material was prepared under the same conditions as those in Example 6 except that the coating solution (1) for a coating layer (C-2) used in Example 6 was replaced with the same coating solution (3) (concentration 10%) as the coating solution (3) that contained a liquid rubber (low-molecular-weight acrylonitrile-butadiene copolymer) and was used in Example 4.

Further, the above surface material was immersed in a 1.0% aqueous solution of a hydrophilic surfactant sodium dioctylsulfosuccinate, squeezed and dried. The thus-obtained surface material had a 40% compression stress of 0.9 g/cm$^2$, and the coating layers (C-2) and (C-1) as a front surface layer had a total thickness of 4.5 μm. The obtained surface material had a water absorption degree of 180 seconds and was highly absorptive of water, and it was also excellent in the tough and gripping characteristic and further was excellent in surface abrasion resistance in practical use. The number of through holes per cm$^2$ of the sheet area was approximately 20,000/cm$^2$ (840 through holes×24/cm$^2$). The top portions of the hill portions thereof had a height of 0.30 mm. The ratio of the area of top portions of the hill portions based on the sheet area was 50%, and the number of the holes on side surface portions of the hills and valleys per cm$^2$ of the sheet area was approximately 11,000/cm$^2$. In the hill portions having the form of a truncated cone each, each hill top portion had an average of 250 holes having an average diameter of 3.0 μm, each side surface had an average of 460 holes having an average diameter of 5.5 μm and each valley bottom portion had an average of 130 holes having an average diameter of 2 μm. Table 2 shows measurement results of the surface material.

Further, the obtained surface material was bonded to bodies inflated with air for volleyball, and the balls were tested, to show that they caused no or little impact in passing them, that they were excellent in the touch, that they were less easily slippery than the sheet-shaped material obtained in Example 6 even if sweat adhered thereto and that they were also excellent in surface abrasion resistance.

TABLE 2

| Items | Ex. 6 | Ex. 7 | Ex. 8 | Ex. 9 | Ex. 10 | CEx. 3 |
|---|---|---|---|---|---|---|
| Thickness, mm | 1.32 | 1.35 | 1.30 | 1.40 | 1.42 | 1.35 |
| Surface water absorption degree, second | 280 | >1000 | 280 | 260 | 180 | 600 |
| Dry friction coefficient | 2.6 | 2.4 | 2.7 | 2.4 | 3.8 | 4.5 |
| Wet friction coefficient | 2.2 | 1.9 | 2.3 | 2.0 | 2.4 | 3.8 |
| Abrasion resistance, Rank | 4 | 4 | 4 | 4 | 3 to 4 | 2 |
| Soiling resistance, Grade | 4 | 4 | 4 | 4 | 4 | 2 |
| Touch, grade | 4 | 3 | 4 | 4 | 4 | 4 |
| Dry gripping characteristic, Grade | 4 | 3 | 4 | 4 | 4 | 3 to 4 |
| Wet gripping characteristic, Grade | 4 | 3 | 4 | 4 | 4 | 3 |
| 40% Compression stress, kg/cm$^2$ | 1.0 | 2.7 | 0.92 | 1.0 | 0.9 | 1.0 |

Ex.: Example,
CEx.: Comparative Example

The invention claimed is:

1. A surface material for balls, formed of a sheet-shaped material having a coating layer on one surface of a base material layer, (1) said coating layer being formed of three layers C-1, C-2 and C-3 which are arranged in the order of C-1, C-2 and C-3 from a front surface side, (2) the layer C-3 being formed from a porous polyurethane elastomer, (3) the layer C-1 being formed from a polyurethane elastomer containing a tackifier wherein said tackifier is a liquid rubber, and (4) the layer C-2 being formed from a polyurethane elastomer, (5) the coating layer having fine through holes reaching the base material layer from the front surface side.

2. The surface material for balls as recited in claim 1, wherein said tackifier is a synthetic liquid rubber having a molecular weight of 800 to 5,000.

3. The surface material for balls as recited in claim 1, wherein the layers C-1 and C-2 have fine through holes reaching the layer C-3 from the front surface side and the through holes are present on the front surface at a rate of at least 500 through holes/$cm^2$.

4. The surface material for balls as recited in claim 1, wherein the coating layer has fine through holes reaching the base material layer from the front surface side, and the through holes are present on the front surface at a rate of at least 1,000 through holes/$cm^2$.

5. The surface material for balls as recited in claim 1, wherein said base material layer is a composite layer formed from a fibrous base material and an elastic polymer.

6. The surface material for balls as recited in claim 1, which has a 40% compression stress of 0.4 to 2.2 kg/$cm^2$.

7. The surface material for balls as recited in claim 1, which has a wet friction coefficient of 1.5 to 4.5 and a surface water absorption degree of 500 seconds or less.

8. The surface material for balls as recited in claim 1, wherein the coating layer has a great number of hills and valleys having a hills-and-valleys height difference of 0.1 to 1.0 mm on the surface thereof, and top portions of hills of the hills-and-valleys have a total area that is 20 to 70% based on the area of the coating layer.

9. The surface material for balls as recited in claim 8, wherein the top portions of the hills of hills-and-valleys of the coating layer are formed of the layers C-1, C-2 and C-3 and bottom portions of the valley are formed of the layer C-3.

10. The surface material for balls as recited in claim 8, wherein said tackifier is a synthetic liquid rubber having a molecular weight of 800 to 5,000.

11. The surface material for balls as recited in claim 8, wherein the layers C-1 and C-2 have fine through holes reaching the layer C-3 from the front surface side and the through holes are present on the front surface at a rate of at least 500 through holes/$cm^2$.

12. The surface material for balls as recited in claim 8, wherein the coating layer has fine through holes reaching the base material layer from the front surface side, and the through holes are present on the front surface at a rate of at least 1,000 through holes/$cm^2$.

13. The surface material for balls as recited in claim 8, wherein said base material layer is a composite layer formed from a fibrous base material and an elastic polymer.

14. The surface material for balls as recited in claim 8, wherein each of top portions of the hills of the hills-and-valleys of the coating layer has an average area of 0.5 to 7 $mm^2$.

15. The surface material for balls as recited in claim 8, wherein each of side surface portions between the hilltop portions and valley bottom portions of the hills-and-valleys of the coating layer has at least 1,000 holes/$cm^2$.

16. The surface material for balls as recited in claim 15, wherein the number of holes on said hilltop portions is not more than 80% of the number of the holes on said side portions of the hills-and-valleys of the coating layer.

17. The surface material for balls as recited in claim 8, which has a 40% compression stress of 0.4 to 2.2 kg/$cm^2$.

18. The surface material for balls as recited in claim 8, which has a wet friction coefficient of 1.5 to 4.5 and a surface water absorption degree of 500 seconds or less.

19. The surface material for balls as recited in claim 1, wherein the coating layer has a substantially flat and smooth surface.

20. The surface material for balls as recited in claim 19, wherein said tackifier is a synthetic liquid rubber having a molecular weight of 800 to 5,000.

21. The surface material for balls as recited in claim 19, wherein the layers C-1 and C-2 have fine through holes reaching the layer C-3 from the front surface side and the through holes are present on the front surface at a rate of at least 500 through holes/$cm^2$.

22. The surface material for balls as recited in claim 19, wherein the coating layer has fine through holes reaching the base material layer from the front surface side, and the through holes are present on the front surface at a rate of at least 1,000 through holes/$cm^2$.

23. The surface material for balls as recited in claim 19, wherein said base material layer is a composite layer formed from a fibrous base material and an elastic polymer.

24. The surface material for balls as recited in claim 19, which has a 40% compression stress of 0.4 to 2.2 kg/$cm^2$.

25. The surface material for balls as recited in claim 19, which has a wet friction coefficient of 1.5 to 4.5 and a surface water absorption degree of 500 seconds or less.

26. A ball comprising the surface material for balls as recited in claim 1, the surface material being bonded to a body for the ball.

27. The surface material for balls as recited in claim 1, wherein the liquid rubber is selected from the group consisting of a low-molecular-weight polybutadiene, a low-molecular-weight acrylonitrile-butadiene copolymer, a low-molecular-weight polydicyclopentadiene, a low-molecular-weight styrene-butadiene copolymer, a low-molecular-weight chloroprene and a low-molecular-weight polystyrene.

28. The surface material for balls as recited in claim 1, wherein the polyurethane elastomer in the layer C-1 having a 100% elongation stress of 30 to 150 kg/$cm^2$.

29. The surface material for balls as recited in claim 1, wherein the content of the tackifier in the layer C-1 is 5 to 100 parts by weight based on 100 parts by weight of solid content of the polyurethane elastomer.

* * * * *